US007967563B1

(12) United States Patent
Liang

(10) Patent No.: US 7,967,563 B1
(45) Date of Patent: Jun. 28, 2011

(54) TURBINE BLADE WITH TIP SECTION COOLING CHANNEL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 888 days.

(21) Appl. No.: 11/986,040

(22) Filed: Nov. 19, 2007

(51) Int. Cl.
*F01D 5/08* (2006.01)
*F01D 5/18* (2006.01)

(52) U.S. Cl. ..... 416/1; 416/97 R; 415/115

(58) Field of Classification Search ..... 416/1, 96 R, 416/96 A, 97 R; 415/115, 116
See application file for complete search history.

(56) References Cited

U.S. PATENT DOCUMENTS 4,474,532 A * 10/1984 Pazder ..... 416/97 R
4,753,575 A 6/1988 Levengood et al.
4,767,268 A 8/1988 Auxier et al.
4,820,122 A 4/1989 Hall et al.
5,403,159 A 4/1995 Green et al.
5,462,405 A 10/1995 Hoff et al.
5,902,093 A 5/1999 Liotta et al.
6,139,269 A 10/2000 Liang
6,168,381 B1 * 1/2001 Reddy ..... 416/97 R
6,431,832 B1 8/2002 Glezer et al.
6,595,748 B2 * 7/2003 Flodman et al. ..... 416/97 R
6,609,884 B2 * 8/2003 Harvey ..... 415/115
6,974,308 B2 * 12/2005 Halfmann et al. ..... 416/97 R
7,059,825 B2 * 6/2006 Magowan et al. ..... 415/115
7,104,757 B2 9/2006 Gross
7,270,515 B2 9/2007 Liang
7,625,178 B2 * 12/2009 Morris et al. ..... 416/97 R
2002/0176776 A1 * 11/2002 Parneix et al. ..... 416/97 R

* cited by examiner

*Primary Examiner* — Igor Kershteyn
(74) *Attorney, Agent, or Firm* — John Ryznic

(57) ABSTRACT

A second stage turbine blade for an IGT includes a leading edge cooling supply channel to provide convection cooling to the leading edge region, and a blade tip cooling channel connected downstream from the leading edge supply channel to provide cooling for the blade tip region. A three-pass aft flowing serpentine cooling circuit provides convection cooling for the mid-chord region and discharges cooling air through a row of trailing edge exit holes or slots. A re-supply hole connects the end of the tip cooling channel to the second leg of the serpentine flow circuit to merge the tip channel cooling air with the serpentine flow cooling air before being discharged through the exit holes.

12 Claims, 4 Drawing Sheets

View A-A

View B-B

View C-C

View D-D

TURBINE BLADE WITH TIP SECTION COOLING CHANNEL

BACKGROUND OF THE INVENTION

1. Field of the Invention

The present invention relates generally to turbine blades, and more specifically to an air cooled turbine blade.

2. Description of the Related Art Including Information Disclosed Under 37 CFR 1.97 and 1.98

In a gas turbine engine, especially an industrial gas turbine engine, a compressor provides compressed air into a combustor to be burned with a fuel and produce a hot gas flow that is passed into a turbine to drive the compressor and, in the case of the IGT, to drive an electric generator. The efficiency of the engine can be increased by passing a higher temperature flow into the turbine. However, the turbine inlet temperature is limited to the material properties of the first stage airfoils (rotor blades and stator vanes) and to the amount of cooling provided for the airfoils.

In order to allow for higher turbine inlet temperatures—and, also to increase the engine efficiency—complex cooling circuits have been proposed for the vanes and blades. A combination of convection cooling, impingement cooling and film cooling is used to maximize the cooling effectiveness while minimizing the amount of compressed cooling air bled off from the compressor. Turbine airfoil designers are always trying to maximize the airfoil cooling capability while minimizing the amount of cooling air used.

FIG. 1 shows a prior art turbine blade with an internal cooling circuit that includes a leading edge cooling channel 11 with trip strips along the inner channel walls, and a blade tip cooling hole 15 at the end of the channel. The blade cooling circuit also includes a aft flowing triple pass or 3-pass serpentine flow cooling circuit (all convective cooling) with a first leg 21 connected to the cooling air supply that flows upward toward the tip, a second leg 22 that flows downward toward the root, and a third leg 23 that flows upward and positioned along the trailing edge region of the blade. A row of cooling air exit holes 24 are placed along the trailing edge and connected to the third leg of the serpentine flow circuit. Trip strips are also located along the serpentine passages. FIG. 2 shows a cross section view of the blade of FIG. 1 taken through the section A-A.

In the prior art blade of FIG. 1, compressed cooling air is supplied to the leading edge cooling channel 11 and the first leg 21 of the serpentine flow circuit from the pressurized cooling air source such as the compressor. The cooling air in the leading edge channel 11 flows upward toward the blade tip. The leading edge channel has a rough triangular cross section shape as seen in FIG. 2. The inner surface area of the leading edge cooling channel 11 is reduced in cross sectional area to an apex of an acute angle. As such, the distribution of the cooling flow to the leading edge corner decreases and the flow velocity as well as the heat transfer coefficient is comparatively reduced. The spent cooling air is then discharged at the blade tip section through the tip cooling opening 15 at the end of the channel as represented by the arrow in FIG. 1. Since the cooling channel has to satisfy the minimum ceramic core size in order for the blade to be cast, frequently the tip cooling hole ends up as an oversized cooling flow passage for the leading edge channel at the exit open region. In addition, the discharge open region at the blade tip location is also subject to the mainstream pressure variations. Mal-distribution of the cooling flow as well as mal-metal temperature at the blade leading edge upper channel location is evidenced in the engine hardware. Also, a single pass radial channel cooling is not the best way of utilizing the total amount of cooling air. In the FIG. 1 prior art blade cooling circuit, about 25% of the cooling air supplied to the blade flows into the leading edge cooling channel 11 while the remaining 75% flows through the serpentine flow circuit by entering the first leg 21. All of the cooling air flow through the leading edge channel 11 is discharged out the blade tip opening 15 and wasted.

FIG. 5 shows another prior art turbine blade with a similar internal cooling circuit to that of FIG. 1 having a separated leading edge cooling feed channel 11 for the airfoil that also feeds a leading edge backside impingement cavity 13 through metering and impingement holes 12, and showerhead cooling circuit 14. The blade in FIG. 5 also includes a blade tip discharge cooling hole 25 at the end of the third leg 23 in the 3-pass serpentine circuit. FIG. 6 is a cross section view of the blade of FIG. 5 taken along the line D-D in order to maintain the leading edge feed channel 11 through flow velocity high enough to overcome the rotational effect at the blade upper span, a considerable amount of cooling air has to be used in the through flow channel while cooling air is bled off from the through flow channel to provide the blade leading edge backside impingement and showerhead film cooling. This additional upper span cooling air is then discharged through the core print out holes 15 and 25 at the blade tip section as represented by the two arrows in FIG. 5 like in the FIG. 1 blade, the cooling air passing through the leading edge channel 11 that is not bled off through the showerhead film holes 14 is discharged out through the tip opening 15 and wasted.

BRIEF SUMMARY OF THE INVENTION

It is an object of the present invention to provide for an air cooled turbine blade with an improved airfoil leading edge cooling effectiveness while also improving the aft flowing serpentine cooling circuit with the same amount of cooling flow than that of the cited prior art references.

It is another object of the present invention to provide for an air cooled turbine blade in which the cooling air used for the leading edge channel can be re-used to cool other parts of the blade without being discharged and wasted.

It is another object of the present invention to provide for an air cooled turbine blade in which the cooling air flow to the low temperature surfaces of the mid-chord region can be reduced in order to more efficiently use the cooling air available for the blade.

One way to improve the airfoil leading edge cooling effectiveness while at the same time improving the aft flowing serpentine cooling circuit with the same amount of cooling flow is by re-using the cooling air from the airfoil leading edge single pass tip discharge cooling air. The blade leading edge discharge cooling air can be used in the aft flowing serpentine flow channels to generate additional internal cooling capability. With the cooling flow circuit of the present invention, the serpentine channel flow through velocity and the internal heat transfer coefficient are both increased.

In one embodiment, cooling air flows through a leading edge channel and along the blade tip toward the trailing edge of the blade to be joined with the cooling air from the 3-pass serpentine flow circuit at the entrance to the second leg of the serpentine passage. The combined cooling air then passes into the third leg of the serpentine flow circuit and is discharged through the trailing edge exit holes. In this embodiment, all of the cooling air within the blade provides convective cooling until being discharged out through the exit cooling holes. The cooling circuit is intended for use in a second stage turbine blade of an industrial gas turbine engine.

In a second embodiment of the present invention, cooling air in the leading edge cooling supply channel is bled off through a row of impingement holes into a leading edge impingement cavity, and then through a row of showerhead film holes and out the leading edge region of the blade. The remaining cooling air flow through the leading edge supply channel continues along the blade tip and is combined at the entrance to the second leg as in the first embodiment, and then discharged out the trailing edge through a row of exit cooling holes. The cooling circuit is intended for use in a second stage turbine blade of an industrial gas turbine engine.

A cover plate for the supply channel of the serpentine flow circuit includes a metering hole in which the cooling air flow can be regulated in order to pass more cooling air to the leading edge region and less cooling air to the lower temperature surfaces of the mid-chord region of the blade.

DETAILED DESCRIPTION OF THE INVENTION

Figure 1:
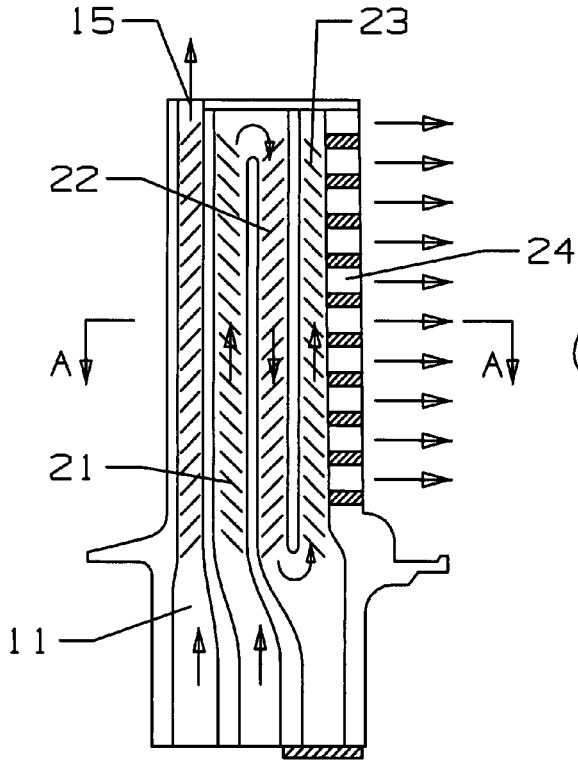
Fig 1 Prior Art
FIG. 1 shows a cross section side view of a prior art turbine blade internal cooling circuit.
Figure 2:
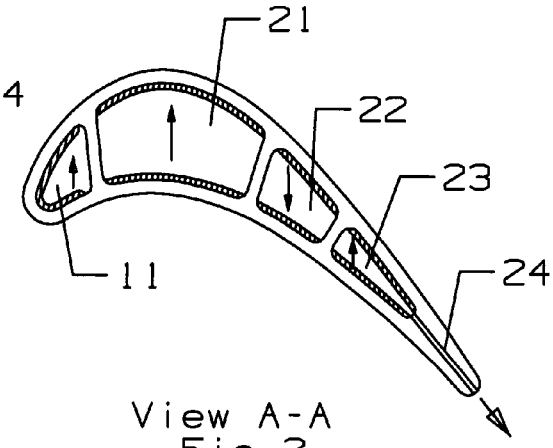
Fig 2 Prior Art
FIG. 2 shows a cross section view of the prior art FIG. 1 turbine blade through the line A-A.
Figure 3:
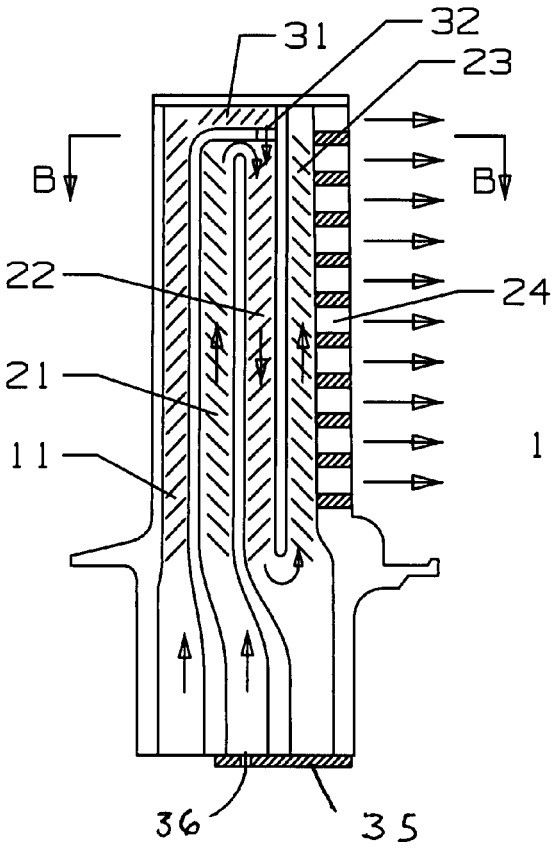
FIG. 3 shows cross section side view of a first embodiment of the present invention of an improvement of the FIG. 1 prior art turbine blade.
Figure 4:
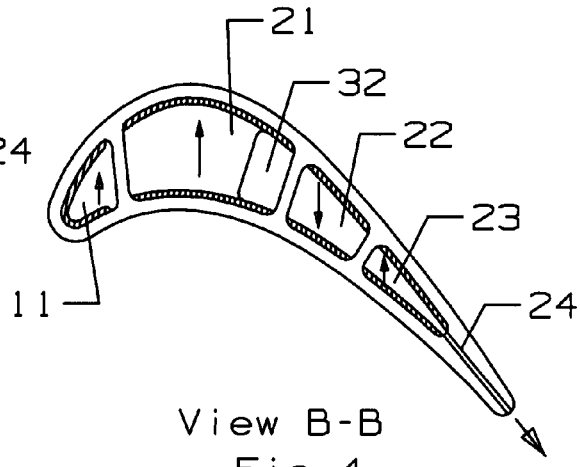
FIG. 4 shows a cross section view through the line B-B of the FIG. 3 blade.
Figure 7:
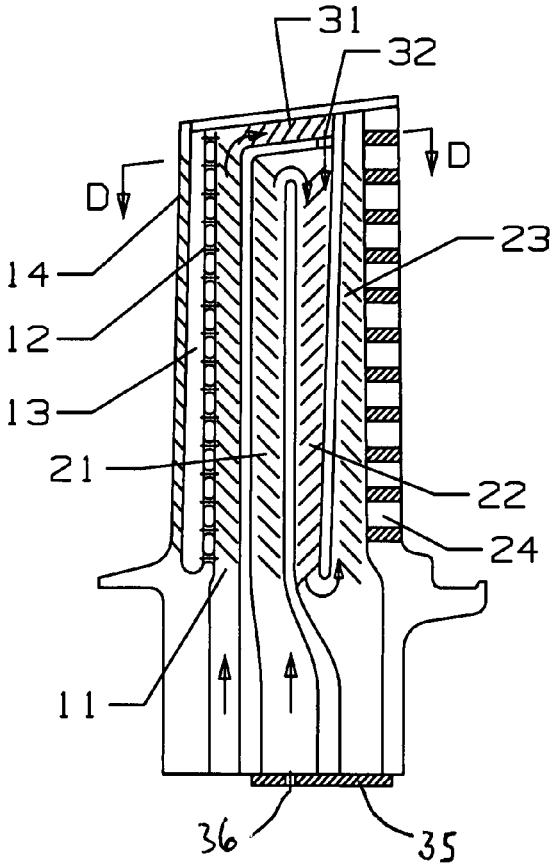
FIG. 7 shows cross section side view of a second embodiment of the present invention of an improvement of the FIG. 1 prior art turbine blade.
Figure 8:
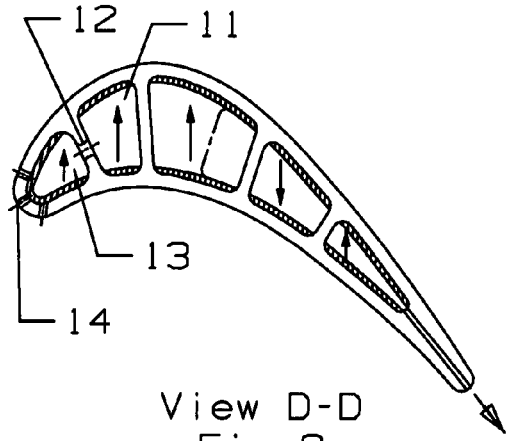
FIG. 8 shows a cross section view through the line D-D of the FIG. 3 blade.

The turbine blade with the cooling circuit of the present invention is shown in FIGS. 3 and 4 for the first embodiment and in FIGS. 7 and 8 for the second embodiment. The cooling circuit is intended for use in a second stage turbine blade of an industrial gas turbine engine. In the first embodiment, a leading edge cooling supply channel 11 is located along the leading edge and connects with a tip section cooling channel 31 that extends from the leading edge to the rib separating the second leg 22 from the third leg 23. The 3-pass serpentine flow cooling circuit includes the first leg 21, the second leg 22 and the third leg 23 as in the prior art FIG. 1 turbine blade. In the first embodiment, the ribs at the corner are curved to better channel the cooling air into the tip cooling channel 31. Also in the first embodiment is the re-supply cooling hole 32 that connects the end of the tip cooling channel 31 to the entrance to the third leg 23 of the 3-pass serpentine flow circuit. A row of exit cooling holes 24 are arranged along the trailing edge and connect with the third leg 23. FIG. 4 shows a top view of the leading turbine blade cooling circuit of the first embodiment.

Figure 5:
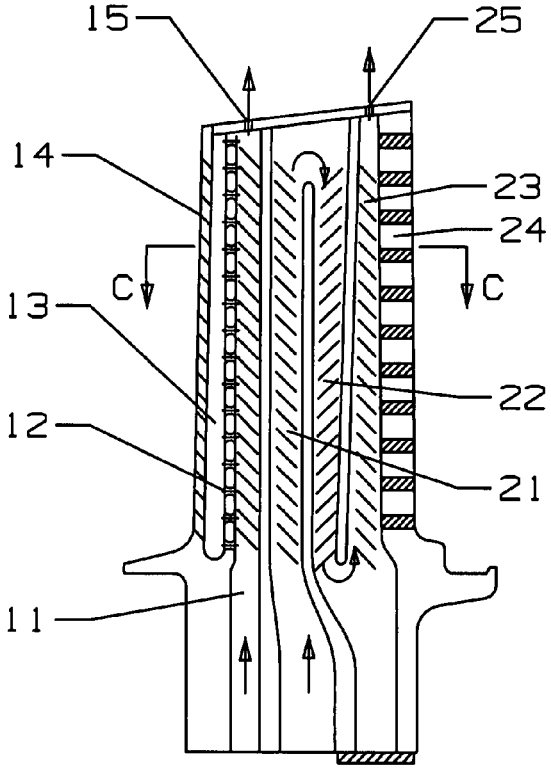
Fig 5 Prior Art
FIG. 5 shows a cross section side view of a second prior art turbine blade internal cooling circuit.
Figure 6:
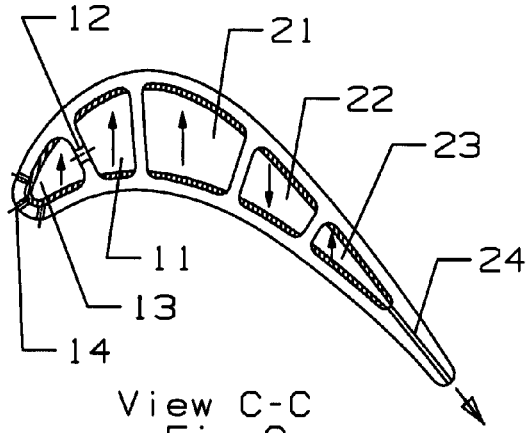
Fig 6 Prior Art
FIG. 6 shows a cross section view of the prior art FIG. 5 turbine blade through the line C-C.

A cover plate 35 is placed over the entrance to the serpentine flow channels and includes a metering hole 36 at the entrance to the first leg of the serpentine flow circuit. The metering hole 36 is sized to regulate the pressure and flow of cooling air entering the serpentine flow circuit. Regulating the flow of cooling air into the serpentine flow circuit also regulates the amount of cooling air entering the leading edge cooling channel 11. The first leg channel 21 of the serpentine flow circuit provides convection cooling to the wall of the blade having the lowest temperature. Therefore, not much cooling air is needed in this leg. However, the leading edge region is exposed to the highest temperature and requires the most cooling. With the metering hole 36, the cooling air supplied to the first leg 21 can be controlled such that enough cooling air flows into the leading edge channel 11 to provide the necessary cooling, while re-using the leading edge channel cooling air by merging it with the second leg 22 of the serpentine flow circuit to provide more cooling to the hotter region in which the third leg 23 requires for cooling thus, less cooling air is wasted and more cooling air is used in the hottest surfaces of the blade than in the prior art circuit of FIG. 1 and FIG. 5.

The second embodiment of the present invention is shown in FIG. 7 and includes the same inventive cooling circuit of the first embodiment, and adds the leading edge impingement cavity 13 connected to the leading edge supply channel 11 through the metering and impingement holes 12, and the showerhead arrangement of film cooling holes 14 along the leading edge of the airfoil. FIG. 8 shows a top view of the blade cooling circuit of the second embodiment.

In operation, cooling air flows through the leading edge radial supply channel 11 at a high flow velocity and therefore generate a high rate of internal heat transfer coefficient. The cooling air form the leading edge channel 11 then turns 90 degrees into the tip section cooling channel 31 located on the blade tip region. Spent cooling air from the leading edge channel 11 is accelerated into the outer section of the blade tip turn and then re-supplied into the turn corners of the serpentine circuit at the entrance to the third leg 23. The metering hole in the cover plate is sized to direct enough cooling air into the leading edge channel 11 for sufficient cooling of the leading edge region while not passing too much cooling air into the first leg of the serpentine flow circuit where the heat load is relatively low. In the first embodiment, all of the cooling air in the leading edge cooling channel 11 is sent into the tip cooling channel 31, while in the second embodiment a portion of the leading edge cooling channel 11 air is bled off into the showerhead 14 through the impingement holes 12 and impingement cavity 13 to provide film cooling for the leading edge of the airfoil. The cooling flow arrangement will eliminate the cooling flow separation problem at the outer portion of the tip turn and provide effective cooling for that particular region. In addition, the cooling air is first impinged onto the forward corner of the tip turn and then impinged onto the aft corner of the tip turn flow channel prior to exiting from the tip turn flow channel. The combination effects of impingement cooling and multiple elbow turns greatly improves the blade outer tip region cooling. This cooling air is then merged with the main body serpentine flow cooling air at the end of the blade mid-chord tip turn location. Once again, the cooling air injections into the far end of the blade mid-chord tip turn eliminates the cooling air recirculation issue and enhances the blade tip turn region cooling. In addition, a portion of the serpentine cooling air can be used to cool the airfoil leading edge high heat load region first and then use this cooling air to provide cooling for the airfoil aft section. This trailing of cooling flow based on airfoil heat load and double use of leading edge cooling air improves the blade overall cooling effectiveness level.

The present invention is an alternate way to improve the airfoil leading edge cooling effectiveness at the same time improving the aft flowing serpentine cooling design with the same amount of cooling flow is by re-utilizing the airfoil leading edge single pass tip discharge cooling air. The blade leading edge discharge cooling air can be used in the aft flowing serpentine flow channels to generate additional internal cooling capability. With the cooling flow arrangement of the present invention, the serpentine channel through flow velocity and the internal heat transfer coefficient are both increased. This result is produced by extending the leading edge flow channel to wrap around the blade leading edge tip section.

I claim the following:

1. An air cooled turbine blade comprising:

a leading edge cooling supply channel extending along a leading edge region from a root to a tip of the blade;

a tip section cooling channel connected to the leading edge supply channel such that cooling air from the leading edge supply channel flows into the tip section cooling channel;

an aft flowing serpentine flow cooling circuit with a last leg located adjacent to the trailing edge region of the blade;

a row of exit cooling holes or slots extending along a trailing edge region of the blade and connected to the last leg of the serpentine flow circuit; and, a re-supply hole connecting the tip section cooling channel to a second-to-a-last leg of the serpentine flow circuit such that cooling air flows through the leading edge supply channel, into the tip section cooling channel, and then joins a cooling air flow in the serpentine flow cooling circuit.

2. The air cooled turbine blade of claim 1, and further comprising:

a spanwise extending rib separating the last leg from the second-to-the-last leg in the serpentine flow circuit, the rib extending to the blade tip such that cooling air flowing in the tip section cooling channel flows through the re-supply hole.

3. The air cooled turbine blade of claim 1, and further comprising:

the aft flowing serpentine flow cooling circuit is a 3-pass serpentine circuit.

4. The air cooled turbine blade of claim 1, and further comprising:

the leading edge cooling supply channel is a convection cooling only channel.

5. The air cooled turbine blade of claim 1, and further comprising:

a leading edge impingement cavity located adjacent to the leading edge cooling supply channel;

a plurality of metering and impingement holes connecting the leading edge supply channel to the leading edge impingement cavity; and, a showerhead arrangement of holes connected to the impingement cavity.

6. The air cooled turbine blade of claim 5, and further comprising:

a spanwise extending rib separating the last leg from the second-to-the-last leg in the serpentine flow circuit, the rib extending to the blade tip such that cooling air flowing in the tip section cooling channel flows through the re-supply hole; and, the rib is slanted such that the adjacent legs decrease in flow area in the direction of cooling air flow through the legs.

7. The air cooled turbine blade of claim 1, and further comprising:

trip strips in the leading edge supply channel and the serpentine flow channels to promote heat transfer from the walls to the cooling air.

8. The air cooled turbine blade of claim 1, and further comprising:

a metering hole located upstream of the first leg of the serpentine flow cooling circuit for regulating the flows of cooling air into the leading edge cooling channel and the serpentine flow cooling circuit.

9. A process for cooling a turbine blade for use in a gas turbine engine, the process comprising the steps of:

passing cooling air along the leading edge region to produce convection cooling;

passing cooling air along an aft flowing serpentine cooling passage through the mid-chord region to produce convection cooling;

passing at least some of the leading edge region cooling air along the blade tip region to produce convection cooling of the blade tip region;

passing the blade tip region cooling air into the aft flowing serpentine cooling air to merge therewith; and, discharging the merged cooling air out through the trailing edge region to produce convection cooling in the trailing edge region.

10. The process for cooling a turbine blade of claim 9, and further comprising the steps of:

metering a portion of the cooling air from the leading edge region cooling air;

impinging the metered cooling air against the leading edge of the blade; and, discharging the impinging air through film cooling holes to cool the leading edge surface.

11. The process for cooling a turbine blade of claim 10, and further comprising the steps of:

passing the merged cooling air through the last two legs of the serpentine flow passage with a decreasing flow area.

12. The process for cooling a turbine blade of claim 9, and further comprising the steps of:

metering the flow of cooling air into the first leg of the serpentine flow cooling circuit in order to regulate the flow of cooling air into the leading edge cooling channel and the serpentine flow cooling circuit.

* * * * *